US006196412B1

(12) United States Patent
Cattell

(10) Patent No.: US 6,196,412 B1
(45) Date of Patent: Mar. 6, 2001

(54) MULTI-COMPARTMENT CONTAINER

(76) Inventor: Berl Cattell, 7014 N. Sheridan Rd. #1A, Chicago, IL (US) 60626

( * ) Notice: Subject to any disclaimer, the term of this patent is extended or adjusted under 35 U.S.C. 154(b) by 0 days.

(21) Appl. No.: 09/534,269

(22) Filed: Mar. 24, 2000

(51) Int. Cl.[7] ..... B65D 1/24
(52) U.S. Cl. ..... 220/524; 220/254
(58) Field of Search ..... 220/524, 505, 220/254

(56) References Cited

U.S. PATENT DOCUMENTS

| | | | | |
|---|---|---|---|---|
| 2,335,016 | * | 11/1943 | Lorenzen et al. | 220/524 |
| 3,547,303 | * | 12/1970 | Mascia et al. | 220/524 |
| 4,095,712 | * | 6/1978 | Perrella | 220/254 |
| 4,108,152 | * | 8/1978 | Kahler | 220/254 |
| 4,284,200 | * | 8/1981 | Bush et al. | 220/254 |
| 4,693,399 | * | 9/1987 | Hickman et al. | 220/254 |
| 4,898,292 | * | 2/1990 | Ver Weyst et al. | 220/254 |
| 4,991,737 | * | 2/1991 | Edelman | 220/254 |
| 5,335,813 | * | 8/1994 | Qi | 220/524 |
| 5,492,244 | * | 2/1996 | Kim | 220/524 |
| 5,499,738 | * | 3/1996 | Burleigh | 220/524 |
| 5,881,924 | * | 3/1999 | House | 220/524 |

FOREIGN PATENT DOCUMENTS

| | | | | |
|---|---|---|---|---|
| 1071351 | * | 4/1954 | (FR) | 220/524 |

* cited by examiner

*Primary Examiner*—Joseph M. Moy
(74) *Attorney, Agent, or Firm*—Goldstein & Canino

(57) ABSTRACT

A container, for storing a variety of objects, comprising a housing having a first end, a second end, and two lids—one lid located at the first end and one lid located at the second end. Dividers are provided within the container to create distinct compartments therein. The compartments may include a transverse divider which creates distinct compartments at the first end and second end, and a longitudinal divider, which creates distinct compartments which each extend between the first end and second end. Both a transverse divider and two or more longitudinal dividers may be employed to create four or more compartments. Each of the lids having one or more lid flaps to provide access to the compartments therein. Snap in pourers may be inserted into the lids immediately beneath one or more of said lid flaps to control the pouring of granular substances.

2 Claims, 2 Drawing Sheets

MULTI-COMPARTMENT CONTAINER

BACKGROUND OF THE INVENTION

The invention relates to a multi-compartment container. More particularly, the invention relates to a container which is divided internally so as to provide multiple compartments and which accordingly provides multiple access ports to the contents of said compartments.

Any substance of a liquid, pasty or granular nature must be stored in a container. Further, foods of all types are often stored in containers to prevent contamination and to slow or prevent decay or spoilage thereof. In addition, small items such as beads, nails and screws, seeds, hobby parts, and the like must be stored in containers, or they will quickly become lost.

Over the years, numerous types of containers have been devised in an attempt at meeting a particular storage goal—such as storing small items, preventing a child's access to the container's contents, showing a consumer when a product has been tampered with, etc. However, all of these attempted solutions have failed to provide an effective storage container which simply allows multiple products to be contained within while providing convenient access to all such products.

While these units may be suitable for the particular purpose employed, or for general use, they would not be as suitable for the purposes of the present invention as disclosed hereafter.

SUMMARY OF THE INVENTION

It is an object of the invention to produce a container which allows multiple products to be stored within the same housing. Accordingly, the container housing has one or more dividers which create multiple compartments within the housing, which each allow storage of a distinct product.

It is another object of the invention to provide a container which allows each of the products to be separately accessed. Accordingly, multiple lids or multiple lid flaps are provided to allow access to each of the separately divided compartments.

It is a further object of the invention to provide a container which can provide multiple access points to the same compartment. Accordingly, the container may be provided with lids on opposite sides of the container housing, wherein each compartment is thereby is communication with more than one of said lids, and accordingly access is provided to each of the compartments from opposite sides. Further, multiple access points allows the user to ensure that they have retrieved all of the product stored within the compartment.

It is still a further object to provide a container which is inexpensive to manufacture. Accordingly, the container of the present invention is configured so that it is susceptible for manufacture using standard manufacturing techniques and procedures and using standard components with little modification.

The invention is a multiple-compartment container, for storing a variety of objects, comprising a housing having a first end, a second end, and two lids—one lid located at the first end and one lid located at the second end. Dividers are provided within the container to create distinct compartments therein. The compartments may include a transverse divider which creates distinct compartments at the first end and second end, and a longitudinal divider, which creates distinct compartments which each extend between the first end and second end. Both a transverse divider and two or more longitudinal dividers may be employed to create four or more compartments. Each of the lids having one or more lid flaps to provide access to the compartments therein. Snap in pourers may be inserted into the lids immediately beneath one or more of said lid flaps to control the pouring of granular substances.

To the accomplishment of the above and related objects the invention may be embodied in the form illustrated in the accompanying drawings. Attention is called to the fact, however, that the drawings are illustrative only. Variations are contemplated as being part of the invention, limited only by the scope of the claims.

BRIEF DESCRIPTION OF THE DRAWINGS

In the drawings, like elements are depicted by like reference numerals. The drawings are briefly described as follows.

DETAILED DESCRIPTION OF THE PREFERRED EMBODIMENTS

Figure 1:
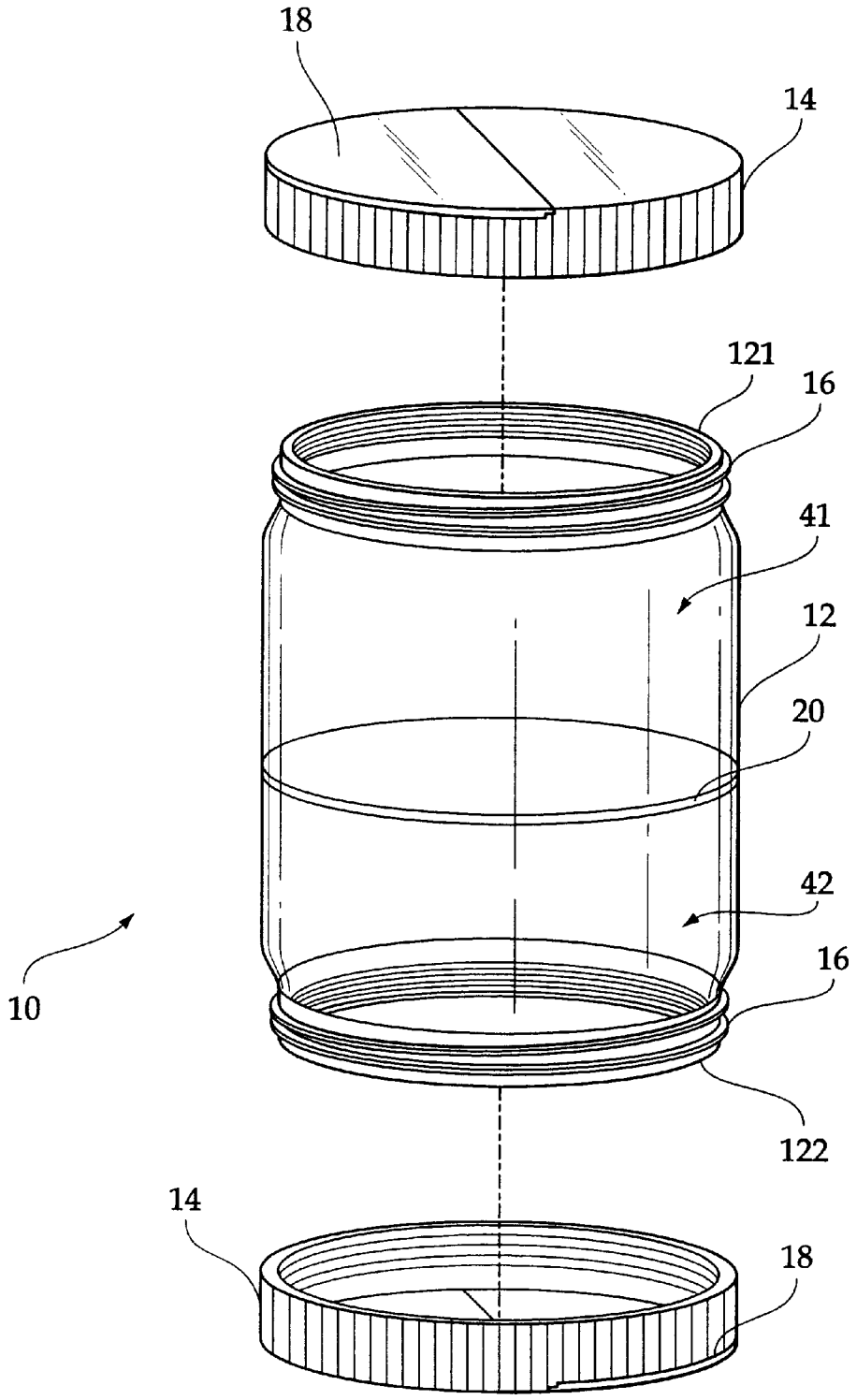
FIG. 1 is an assembly drawing, illustrating an embodiment of the invention, wherein the housing has two lids, each separately removable at opposite ends thereof, and is divided into two compartments by a transverse divider, the lids providing separate access to each of the compartments.

FIG. 1 illustrates a container 10, comprising a housing 12 and a pair of lids 14. The housing 12 defines an interior volume and includes a first end 121 and a second end 122. The housing is illustrated in FIG. 1 as being substantially cylindrical, although other shapes having a generally extruded appearance or configuration may be employed. As illustrated, the housing 12 is substantially transparent, allowing a user to view contents of the container 10. The first end 121 and second end 122 each have a lid mounting 16 for selectively fastening one of the lids 14 thereat. In the embodiment illustrated in FIG. 1, the lid mounting 16 is an external screw thread on the housing 12 adjacent to the first end 121 and second end 122. Each lid 14 has one or more lid flap 18, which allows access through said lid 14.

In the embodiment illustrated in FIG. 1, the container 10 has a transverse divider 20, which extends horizontally across the container 10, substantially parallel to the first end 121 and second end 122. The transverse divider 20 creates a first compartment 41 and a second compartment 42. The first compartment is adjacent to the first end 121, and accordingly is accessed using the lid 14 mounted at said first end 121. The second compartment is adjacent to the second end 122, and accordingly is accessed using the lid 14 mounted at said second end 122.

Figure 2:
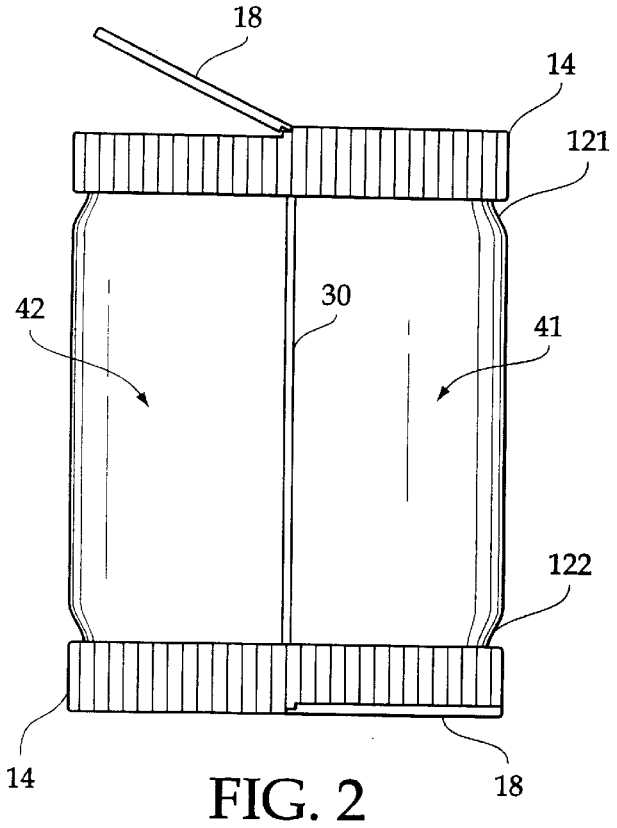
FIG. 2 is a side elevational view of the invention, showing an embodiment wherein the housing has two lids, and wherein two compartments are divided by a longitudinal divider, which allows each of the compartments to be accessed with a distinct lid.

According to another embodiment, illustrated in FIG. 2, the container has a longitudinal divider 30, which extends vertically along the container 10, substantially perpendicular to both the first end 121 and second end 122, and extends substantially between said first end 121 and second end 122. The first compartment 41, and second compartment 42 created by the longitudinal divider 30 both extend substantially between the first end 121 and second end 122. As illustrated in FIG. 2, carefully placed lid flaps 18 on opposite lids 14 each provide separate access to the first compartment 41 or second compartment 42.

Although one lid flap 18 per compartment is shown in FIG. 2, two lid flaps can be provided for each compartment—one on each of the lids. Such a configuration would allow multiple access points for each compartment, and will allow all of the stored contents to be accessed through said lid flaps 18.

Figure 3:
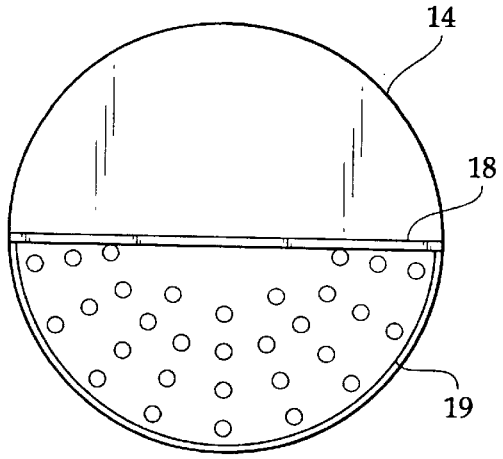
FIG. 3 is a top plan view, illustrating one of the lids, wherein one of the lid flaps has been opened to illustrate a snap-in perforated pourer insert.

FIG. 3 is a top plan view, illustrating one of the lids 14, wherein one of the lid flaps 18 is in the open position. In addition, a pourer insert 19 has been inserted into the lid 14 beneath the lid flap 18, to control release of contents from the container. The pourer insert 19 may be employed when fine granular products are stored within the container 10. The pourer insert 19 may be selectively snapped in to allow pouring such products, or may be removed therefrom to allow the container to be filled, the container to be rapidly removed of product, or the container to be used for non-granular products.

Figure 4:
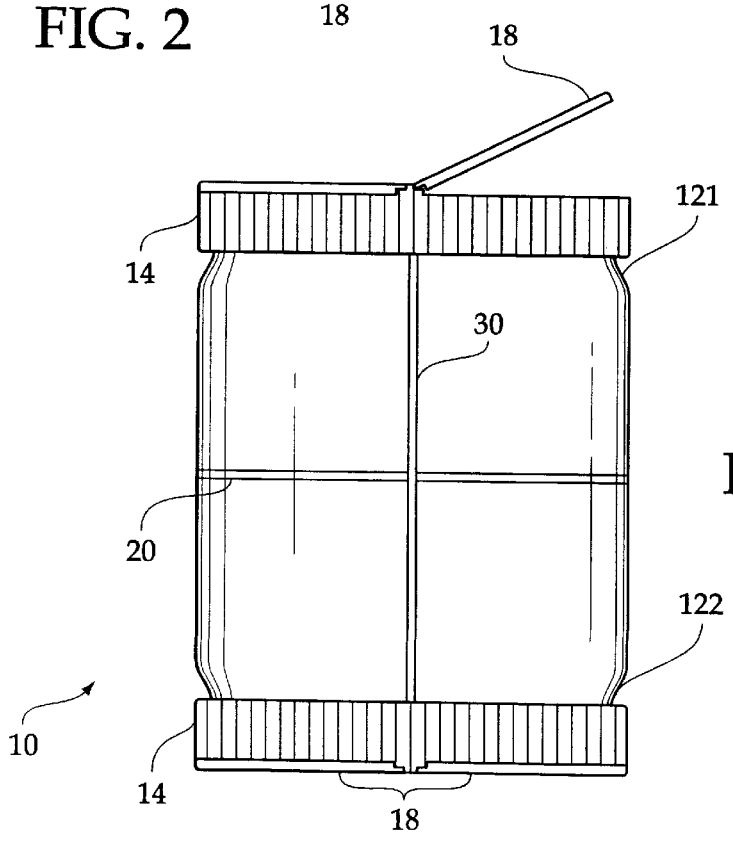
FIG. 4 is a side elevational view, illustrating another embodiment of the invention, having both longitudinal and transverse dividers, such that four compartments are created with the housing, each accessible with a unique lid flap.

FIG. 4 shows a further embodiment of the container 10, in which both a longitudinal divider 30 and a transverse divider 20 are present within the same housing 12. The longitudinal divider 30 and transverse divider 20 together define four compartments—two of which are adjacent to the first end 121 and two of which are adjacent to the second end 122. Accordingly, each of the lids 14 has two lid flaps 18 for accessing the two compartments adjacent to said lid 14.

In the same manner of the invention illustrated in FIG. 4, eight compartments can be formed by having one transverse divider 20 and two longitudinal divider 30. Accordingly, eight lid flaps 18 would separately provide access the eight compartments of the container 10.

In conclusion, herein is presented a container which provides storage of multiple items, and allows superior access to the contents stored therein. Although examples of the invention has been illustrated in the form depicted in FIG. 1–4, numerous variations are possible. Accordingly such variations, within the spirit of the invention, are considered to be a part thereof in accordance with the appended claims.

What is claimed is:

1. A container, comprising:

a housing having a first end and a second end, the housing defining an interior volume, the housing having lid mountings at both the first end and second end;

a transverse divider extending substantially parallel to the first end and second end, dividing the interior volume into two compartments, one of said compartments adjacent to the first end, the other of said compartments adjacent to the second end;

a longitudinal divider extending substantially perpendicular to and substantially between the first end and second end, the longitudinal divider further subdividing the interior volume so that said longitudinal divider along with the transverse divider thereby creates four compartments, two of which are adjacent to the first end, and two of which are adjacent to the second end; and a pair of lids, one lid located at the first end, the other lid located at the second end, the two lids each having two lid flaps, such that said lid flaps separately provide access to the four compartments within the housing.

2. The container as recited in claim 1, further comprising one or more pourer inserts, the pourer inserts may be selectively snapped into one of the lids immediately beneath one of the lid flaps for allowing controlled pouring of granular substances within the compartment immediately adjacent to said lid flap.

* * * * *